US006355142B1

(12) United States Patent
Ahrens

(10) Patent No.: US 6,355,142 B1
(45) Date of Patent: Mar. 12, 2002

(54) METHOD OF CONTROLLING HEADBOX JET VELOCITY FOR FOAMED FURNISHES

(75) Inventor: Frederick W. Ahrens, Hortonville, WI (US)

(73) Assignee: Fort James Corporation of Virginia, Richmond, VA (US)

( * ) Notice: Subject to any disclaimer, the term of this patent is extended or adjusted under 35 U.S.C. 154(b) by 0 days.

(21) Appl. No.: 07/974,832

(22) Filed: Nov. 16, 1992

Related U.S. Application Data

(63) Continuation of application No. 07/607,509, filed on Nov. 1, 1990, now abandoned.

(51) Int. Cl.[7] ..... D21F 1/02; D21F 1/06; D21F 1/08

(52) U.S. Cl. ..... 162/198; 162/253; 162/259; 162/DIG. 11; 700/128

(58) Field of Search ..... 162/253, 259, 162/DIG. 11, 198; 364/471; 700/127, 128, 129

(56) References Cited

U.S. PATENT DOCUMENTS

| | | | | |
|---|---|---|---|---|
| 3,716,449 A | | 2/1973 | Gatward et al. | |
| 3,871,952 A | | 3/1975 | Robertson | |
| 3,937,273 A | | 2/1976 | Radvan et al. | |
| 3,938,782 A | | 2/1976 | Robertson | |
| 3,947,315 A | | 3/1976 | Smith | |
| 4,086,130 A | | 4/1978 | Justus | 162/123 |
| 4,374,703 A | * | 2/1983 | Lebeau et al. | 162/259 |
| 4,384,922 A | * | 5/1983 | Stotz | 162/259 |
| 4,443,297 A | | 4/1984 | Cheshire et al. | |
| 4,443,299 A | | 4/1984 | Cheshire et al. | |
| 4,488,932 A | | 12/1984 | Eber et al. | |
| 4,498,956 A | | 2/1985 | Cheshire et al. | |
| 4,543,156 A | | 9/1985 | Cheshire et al. | |
| 4,686,006 A | | 8/1987 | Cheshire et al. | |
| 4,764,253 A | | 8/1988 | Cheshire et al. | |
| 4,869,782 A | | 9/1989 | Nelson et al. | |

OTHER PUBLICATIONS

Franzen, "Direct Measurement of Jet Velocity as an Aid to Paper Making", *TAPPI J.*, Jul. 1987, p. 63–67.*

Talvio, "A Study of Paper Machine Headbit Control System With Linear Transfer Functions", Congres IFAC: 1966, Landres, p 22A.1–A.13.*

"Sheet Formation & Printability," by B. Radvan et al, presented at the 14th EUCEPA Conferece in Oct., 1971.

"Wet–Laid, Long Fiber Formers," by A.P.J. Gatward, published in *Paper Technology*, vol. 13, No. 4, dated Aug., 1972.

"The Structure and Properties of Paper Formed by a Foaming Process," by M. K. Smith et al, TAPPI, vol. 57, No. 1, Jan., 1974.

(List continued on next page.)

*Primary Examiner*—Steve Alvo
(74) *Attorney, Agent, or Firm*—Michael W. Ferrell

(57) ABSTRACT

Controlling the velocity of a jet of foamed furnish leaving the slice of a pressurized headbox of a paper or a tissue making machine by measuring the density and pressure of a flow of foamed furnish provided by a pump to estimate an atmospheric pressure air content, measuring the pressure of the foamed furnish in the headbox, using the estimated atmospheric pressure air content and the measured pressure in the headbox to estimate the current velocity of said jet of foamed furnish, comparing the estimated current velocity with a target velocity and controlling the pump to move the estimated and target velocities closer to each other. An alternate embodiment controls jet velocity on the basis of comparing estimated and target headbox pressures.

2 Claims, 6 Drawing Sheets

OTHER PUBLICATIONS

"Long–Fibre Developments in U.K. & Europe," by A.P.J. Gatward, published in *Paper Technology*, vol. 14, No. 5, Oct., 1973.

"New Develoments in the Radfoam Process," by R. W. Tringham, published in *Paper Technology*, Oct., 1974, vol. 15, No. 5, pp. 288–294.

Advertisement by the Beloit Corporation of Wisconsin in TAPPI, Feb., 1990.

Van Dyke, M., et al., Annual Review of Fluid Mechanics, vol. 4, pp. 369–396, 1972 (in particular, p. 384).

* cited by examiner

METHOD OF CONTROLLING HEADBOX JET VELOCITY FOR FOAMED FURNISHES

This application is a continuation of application Ser. No. 07/607,509 filed on Nov. 1, 1990, now abandoned.

BACKGROUND AND SUMMARY OF THE INVENTION

The invention relates to the manufacture of fibrous webs in which a foamed fiber-containing slurry is deposited on a moving support to form a continuous web that is further treated to form a product such as tissue paper.

In a common method of manufacturing a paper web, an aqueous slurry (furnish) of wood and/or other fibers is discharged through the outlet (slice or slice opening) of a distributor (headbox) onto a continuously moving foraminous support (Fourdrinier wire) or between facing surfaces of two such moving supports in the form of a continuous fibrous web. This web is dried and subjected to subsequent treatments to form the final paper product. The headbox can provide a single jet, or several jets of the same or different furnishes which may or may not merge into a single jet by the time they reach the moving support.

One of the important factors in this process is control over the slurry jet or jets discharged from the slice or slices, including control over the jet velocity. Such control can influence significantly important properties of the resulting paper product such as the orientation of the fibers in the web and, consequently, properties such as the tensile ratio of the paper product (longitudinal vs. transverse tensile strength). Such control can be important both in the case of single slice headboxes used to make paper products such as tissue as well as in the case of multiple slice headboxes used to make similar products or stratified products such as webs having a bulk-providing central stratum sandwiched between thinner but stronger outer strata.

When a simple slurry of fibers in a liquid is used, control over the jet can be easier than in the case of a foamed slurry where the vehicle in which the fibers are dispersed contains both liquid and gas phases, e.g., when the vehicle is a dispersion of air bubbles in water containing a suitable surfactant. See U.S. Pat. Nos. 4,764,253, 4,086,130 and 3,716,449, which are hereby incorporated by reference. See, also, an advertisement by the Beloit Corporation of Wisconsin in TAPPI, February, 1990 for a headbox producing a jet in the form of multiple thin converging layers. A foamed slurry can be advantageous, e.g., when the slurry contains fibers which have been rendered anfractuous (kinked) by a process such as milling in order to enhance properties of the final product such as bulk and softness. A conventional water furnish tends to relax the fiber kinks at too high a rate but a foamed furnish tends to reduce the exposure of the fibers to water and to maintain their desired anfractuous properties.

The unique properties of foamed furnish with respect to fluid parameters such as density, viscosity, compressibility and effects of temperature and pressure, can introduce significant difficulties in the control over the headbox jet or jets. Because relevant properties of foamed furnish are so dependent on parameters such as air content and temperature, strategies for controlling jet velocity that may be suitable for a conventional slurry of fibers in a liquid may not be appropriate for foamed furnishes. One type of control suitable for foamed furnishes is discussed in said U.S. Pat. No. 4,764,253 and uses the output of a magnetic flowmeter and knowledge of the headbox and the slice cross-sectional areas to calculate a control signal for a pump delivering the furnish to the headbox. Properties of frothy liquids are discussed in Van Dyke, M., et al., Annual Review of Fluid Mechanics, Vol. 4, pp.369–396, 1972 (see, in particular, page 384), but not in the context of paper making. Accordingly, it is believed that a need still remains for a simpler, less expensive and more reliable and effective control, and this invention is directed to meeting such a need.

In one non-limiting example, the invention is embodied in system which uses only measurements of the pressure and density of the furnish using neither direct measurement of flow velocity nor direct measurement of volume flow rate of the furnish jet, which are easily and reliably obtained, to calculate the jet velocity and to control the delivery of furnish to the headbox so as to move the calculated jet velocity toward a target velocity. This can be done in accordance with the invention on the basis of comparing the calculated and target jet velocities or on the basis of comparing a calculated headbox pressure with a target headbox pressure.

In particular, an exemplary embodiment of the invention periodically measures the density of the foamed furnish fed to the headbox, for example with a radioactive mass sensor, and the pressure of the furnish at two points, one before the headbox and another in the headbox. A computing circuit uses these measurements to estimate. (e.g., calculate) the current velocity of the jet emitted from the headbox. The system then compares the estimated current jet velocity with a target velocity which typically is selected on the basis of the machine or wire speeds. The result of this comparison controls the feeding of furnish to the headbox to reduce the difference between the estimated and target jet velocities. In the alternative, the system can use the measurements to estimate (e.g., calculate) a target headbox pressure and can control the feeding of furnish to bring the current measured headbox pressure closer to the estimated target headbox pressure.

The invented system recognizes the influence of the air content and headbox pressure on jet velocity and can optionally use at least one empirical correction factor to enhance the control over jet velocity or headbox pressure. The relationships between measurements and controlled parameters which the invention uses are believed to be particularly efficacious in accounting for the unique properties of foamed furnish in paper making. The invention is believed to be useful for single jet systems, for systems using multiple jets of the same furnish and for systems using stratified jets of different furnishes. One preferred use of the invention is in a paper making line using foam forming and surfactant recovery techniques discussed in copending commonly owned patent applications Ser. No. 07/599,149 filed on Oct. 17, 1990 in the name of John H. Dwiggins and Dinesh M. Bhat and entitled Foam Forming Method and Apparatus, now abandoned and Ser. No. 07/598,995 filed on Oct. 17, 1990 in the name of Dinesh M. Bhat and entitled Recovery of Surfactant From Paper Making Process, now abandoned. However, the invention is not limited to use in such a paper making line.

DETAILED DESCRIPTION

Figure 1:
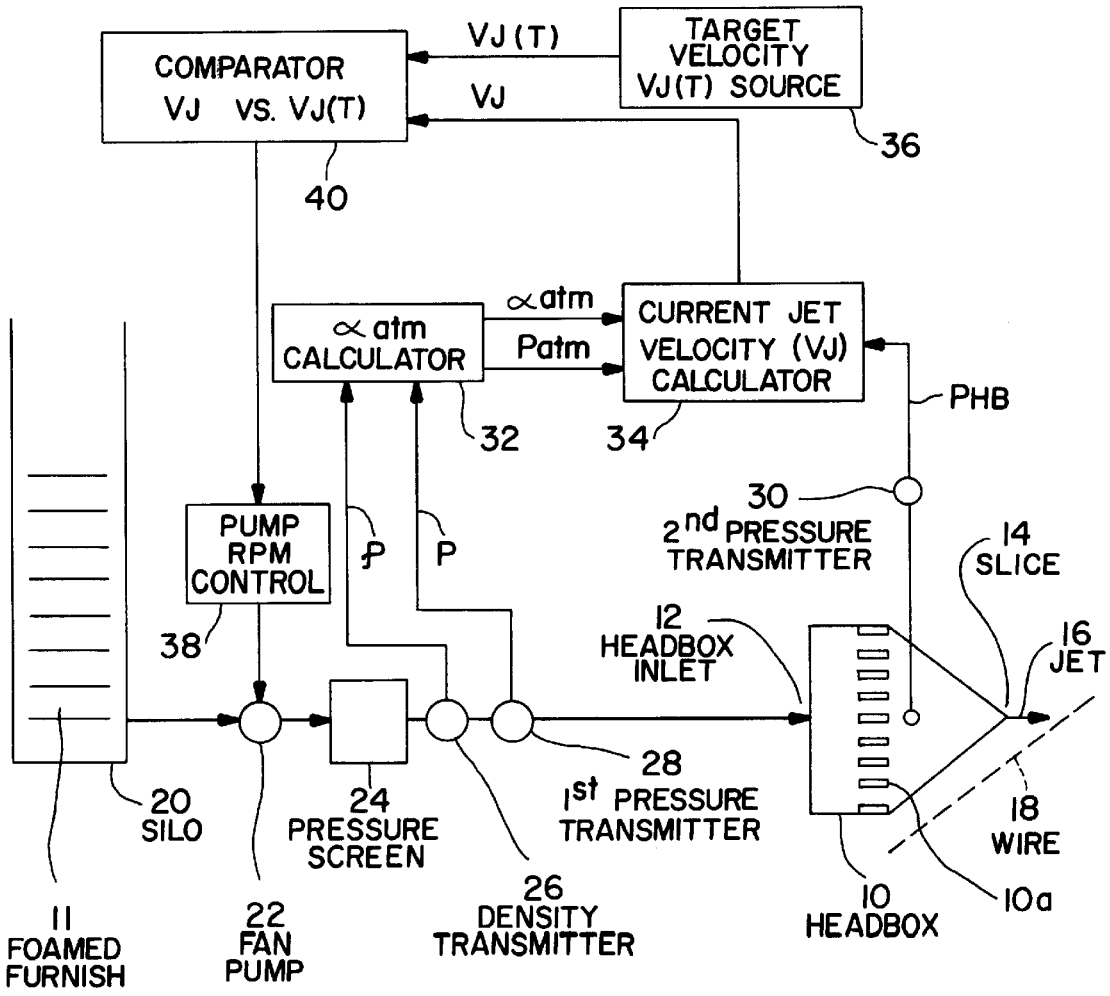
FIG. 1 is a simplified schematic illustration of an exemplary embodiment of the invention controlling jet velocity on the basis of a comparison of a currently calculated jet velocity and a target velocity.

Referring to FIG. 1, an exemplary embodiment of the invention comprises a headbox 10 which has an inlet 12 for receiving foamed furnish 11 and a slice 14 for emitting a jet 16 of foamed furnish onto a continuously moving support (wire) 18. The source of furnish 11 comprises a silo 20 which supplies furnish to a fan pump 22 via a suitable conduit. Pump 22 via a suitable conduit delivers furnish under pressure to a pressure screen 24, which in turn delivers screened furnish via a suitable conduit to inlet 12 of headbox 10. A density transmitter 26, which can comprise a radioactive mass sensor and a suitable circuit for generating and transmitting a measurement signal in a form suitable for use in a computer calculation, measures the density of furnish 11 at pressure as pumped by fan pump 22, at a point between pressure screen 24 and headbox 10. The radioactive mass sensor can be of the type which measures the attenuation that penetrating radiation suffers in passing through the material of interest (foamed furnish) as a measure of the mass density of the material. A first pressure transmitter 28 measures the pressure of the furnish pumped by fan pump 22. Pressure transmitter 28 can comprise a pressure gauge and a suitable circuit for generating and transmitting a measurement signal suitable for use in a computer calculation. Transmitters 26 and 28 preferably are within a few feet downstream from pump 22 and pressure screen 24, but could be at other locations. A second pressure transmitter 30, which can be similar to transmitter 28, measures the pressure of the furnish in headbox 10, at a location downstream from tube bank 10*a* but in the wider part of the converging portion, where the velocity of furnish 11 is relatively low. The density and pressure measured by transmitters 26 and 28 are supplied to a calculating circuit 32 which calculates the volumetric air content fraction of the furnish at atmospheric pressure ($\alpha_{atm}$), using for the purpose a relationship which is discussed in greater detail below. A jet velocity calculator circuit 34 uses the atmospheric pressure air content fraction $\alpha_{atm}$ calculated by circuit 32 and the pressure of the furnish in the headbox as measured by transmitter 30 to calculate an ideal current jet velocity ($V_{J(I)}$) and then corrects $V_{J(I)}$ with an empirically derived correction factor ($C_1$) which is specific to the installation, e.g., to a particular headbox or a class of headboxes, to derive a calculated current velocity ($V_J$) of jet 16, using for the purpose other relationships which are discussed in greater detail below. A comparator circuit 40 compares the current calculated jet velocity $V_J$ with a target jet velocity $V_{J(T)}$ provided from a source 36 and outputs a comparison result which is used as an input to a pump RPM control 38 which controls fan pump 22. In response to this control signal from control 38, pump 22 increases or decreases the rate at which it delivers furnish to headbox 10 as needed to reduce the difference between the calculated and target jet velocities $V_J$ and $V_{J(T)}$. The calculations and control discussed above are carried out at frequent intervals (e.g., at intervals in the range of 1 to 30 seconds. preferably once per second), to keep the calculated and target velocities close to each other. Calculating circuits 32 and 34 and comparator 48 can be implemented in the form of a general purpose digital computer programmed to carry out the steps described in this specification, or partly or fully in the form of special purpose circuits or ASICs (application-specific integrated circuits) carrying out the specified calculations.

Circuit 32 calculates the current volumetric air content fraction at atmospheric pressure $\alpha_{atm}$ in accordance with the invention from the relationship:

$$\rho=\rho_{liq}\{[(1-\alpha_{atm})p_{abs}]/[(1-\alpha_{atm})p_{abs}+\alpha_{atm}p_{atm}]\} \quad (1)$$

where

- $\rho$ is the density of the furnish as measured by transmitter 26;
- $\rho_{liq}$ is the density of the liquid phase of the furnish, which is known or can be measured once or periodically and can be stored as a constant in circuit 32;
- $p_{abs}$ is the absolute pressure of the furnish downstream from pump 22. It equals the sum of the pressure (p) as measured by first pressure transmitter 28 relative to the atmospheric pressure and $p_{atm}$ defined below;
- $\alpha_{atm}$ is the current volumetric air content fraction at atmospheric pressure of the furnish leaving pump 22, expressed as a fraction of unity, as calculated by circuit 32;
- $p_{atm}$ is the absolute atmospheric pressure, which can be stored as a constant in circuit 32. This constant can be updated from time to time, e.g., once or several times a day or week as needed. As an alternative, the output of an atmospheric pressure transmitter can be provided to circuit 32 for use in calculating the current $\alpha_{atm}$.

The variables and constants in expression (1) as well in the expressions discussed below, can be in any self-consistent system of units.

Figure 2:
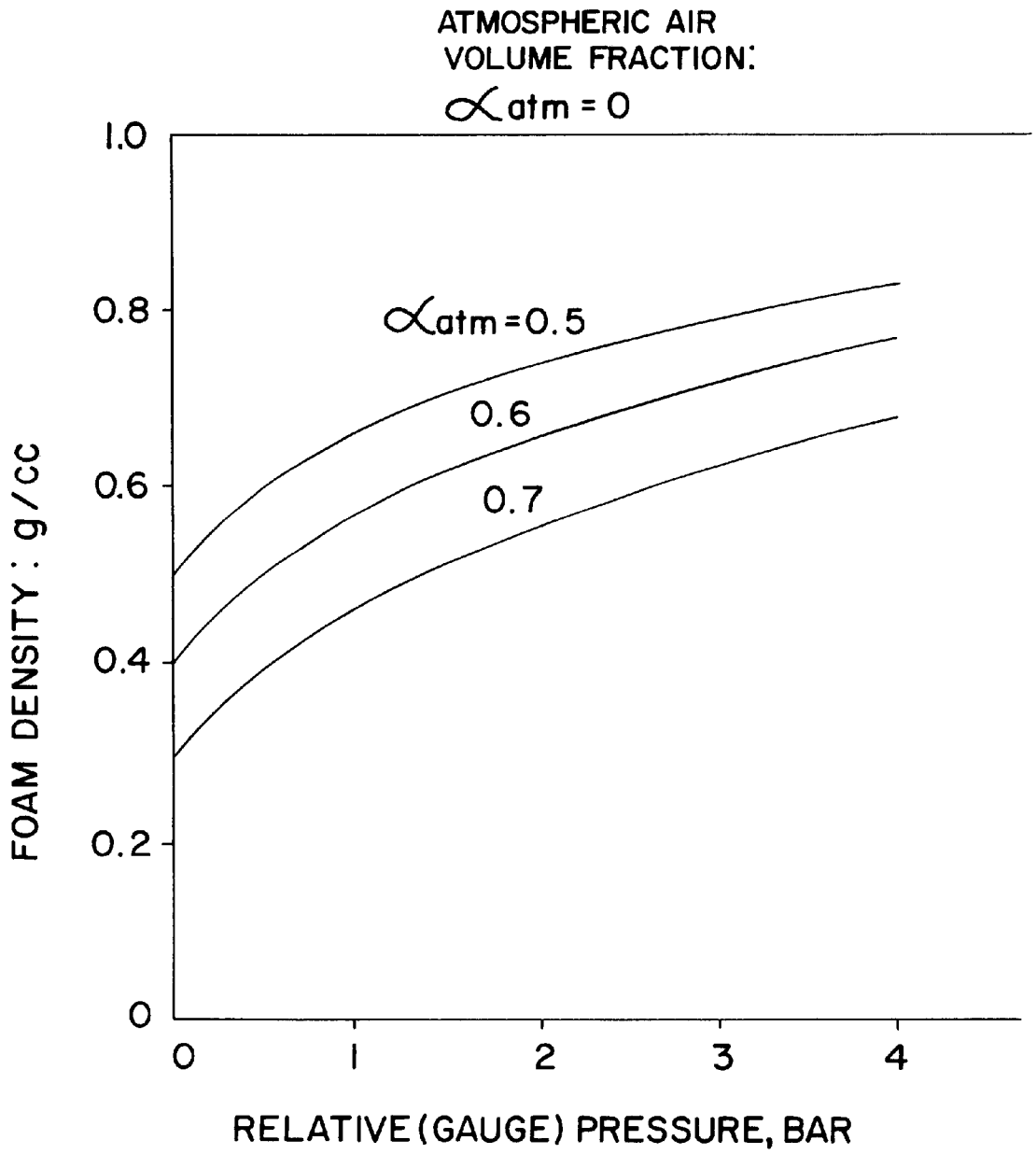
FIG. 2 illustrates a relationship between the density of a foamed furnish and the furnish pressure at different air content fractions of the furnish in an exemplary process embodying the invention.
Figure 3:
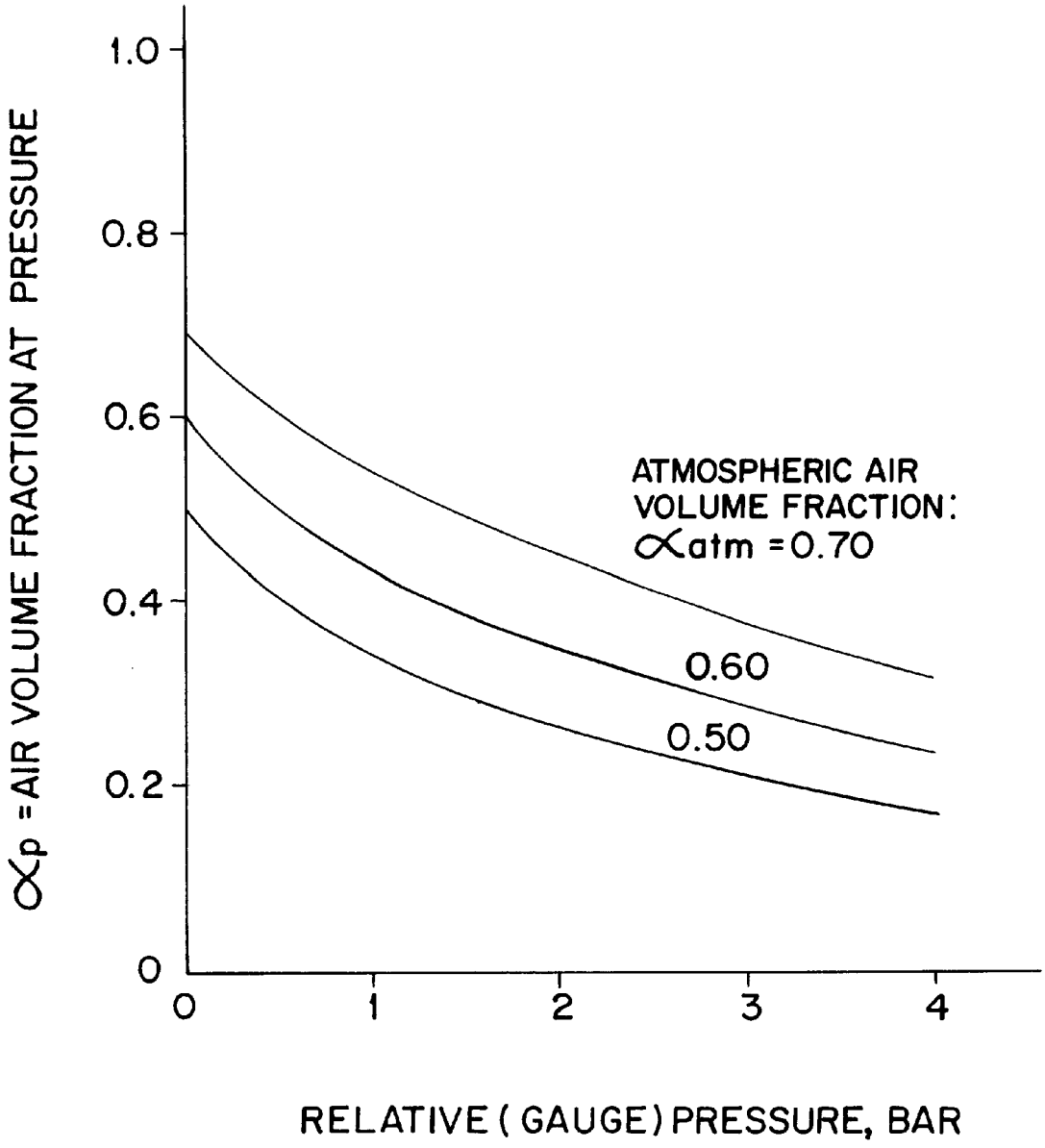
FIG. 3 illustrates a relationship between the air volume fraction in the furnish at pressure and the furnish pressure at different air content fractions at atmospheric pressure in an exemplary process embodying the invention.

FIGS. 2 and 3 illustrate exemplary relationships between the relative pressure (p) as measured by transmitter 28 and the density ($\rho$) of foamed furnish 11 and the air volume fraction at pressure for different atmospheric pressure air volume fractions $\alpha_{atm}$ for an exemplary embodiment of the invention.

After circuit 32 calculates the current volumetric air content fraction at atmospheric pressure $\alpha_{atm}$ as discussed above, circuit 36 calculates the current ideal jet velocity $V_{J(I)}$ in accordance with the relationship $$(V_{J(I)})^2=2\{(p_{HB(abs)}-p_{atm})/\rho liq+g\Delta h+[(\alpha_{atm}p_{atm})/\rho_{liq}(1-\alpha_{atm})][\ln(p_{HB(abs)}/p_{atm})\}/[1-(\rho_2{}^2A_2{}^2)/(\rho_1{}^2A_1{}^2)] \quad (2)$$

where

- $p_{HB}$ is the pressure relative to the atmospheric pressure in headbox 10 as measured by second pressure transmitter 30;
- $p_{HB(abs)}$ is the absolute pressure in headbox 10, derived in circuit 34 as the sum ($p_{HB}+p_{atm}$);
- $p_{atm}$ is the absolute atmospheric pressure, derived as earlier noted in circuit 32 and supplied thereby to circuit 34;
- $\rho_{liq}$ is the density of the liquid phase of the furnish, which is known or can be measured once or periodically and can be stored as a constant in circuit 34;

g is acceleration due to gravity;

$\Delta h$ is the elevation difference between pressure transmitter 30 and jet 16 (>0 when jet 16 is at a lower elevation than pressure transmitter 30);

$\alpha_{atm}$ is the current volumetric air content fraction at atmospheric pressure of the furnish downstream from pump 22, in volume fraction of unity, as provided from circuit 32;

$\rho_1$ is the density of furnish 11 at the entrance to the converging part of headbox 10, which can be calculated from a special case of equation 1 for which $p_{abs}=p_{HB(abs)}$ and $$\rho_1=\rho_{liq}\{[(1-\alpha_{atm})p_{HB(abs)}]/[(1-\alpha_{atm})p_{HB(abs)}+\alpha_{atm}p_{atm}]\};$$

$\rho_2$ is the density of the furnish leaving the slice (i.e., at atmospheric pressure), which also can be calculated from a special case of equation 1 for which $p_{abs}=p_{atm}$ and $\rho_2=\rho_{liq}(1-\alpha_{atm})$;

$A_1$ is the known area at the entrance to the converging part of headbox 10, which can be stored as a constant in circuit 34; and $A_2$ is the area of the slice of headbox 10, which can be measured and stored as a constant in circuit 34.

The last term in square brackets of expression (2) for $V_{J(I)}$ is close to unity and usually may be omitted in practicing the invention. Then, expression (2) reduces to $$(V_{J(I)})^2=2\{(p_{HB(abs)}-p_{atm})/\rho_{liq}+\Delta h+[(\alpha_{atm}p_{atm})/\rho_{liq}(1-\alpha_{atm})][\ln(p_{HB(abs)}/p_{atm})]\} \quad (3)$$

However, expression (2) can be used instead of expression (3) in case the last term in square brackets of expression (2) proves to be significantly different from unity in a particular implementation of the invention.

Circuit 34 then converts the current ideal jet velocity $V_{J(I)}$ calculated as described above to a current calculated jet velocity $V_J$ in accordance with the relationship $$V_J=C_1V_{J(I)} \quad (5)$$

where $C_1$ is a correction factor.

The correction factor $C_1$ is determined empirically for a particular implementation of the invented system (or at least for a particular headbox or class of headboxes). In a particular experimental system of the assignee embodying the invention $$C_1=a+b(V_{J(I)}-c) \quad (5)$$

where a, b and c are coefficients which for a particular experimental embodiment of the invention have such values that expression (5) becomes $$C_1=1.000+0.000246(V_{J(I)}-1510) \quad (6)$$

Note that units of meters/min are used for $V_{J(I)}$ in equation 6.

This relationship was determined empirically by plotting the actual jet velocity determined in an experimental system of the assignee embodying the invention versus the calculated ideal jet velocity $V_{J(I)}$ and curve-fitting expression (6) to the plot. Of course, a number of actual velocities and corresponding terms $V_{J(I)}$ were used to construct the plot. Each actual velocity was determined as the ratio of the volumetric flow rate at the slice of the headbox and the measured flow area of the slice. The volumetric flow rate at the slice was determined by using a magnetic flow meter to measure the volumetric flow rate in the headbox approach pipe (i.e., near the location of pressure transmitter 28 in FIG. 1) and then correcting (using Equation 1) for the density change that occurs during transit through the headbox to the slice, at steady state conditions. The magnetic flow meter used for this purpose was of the type discussed in said U.S. Pat. No. 4,764,253. The correction factor $C_1$ need be found only once for a particular installation (except for possible infrequent recalibrations) and could be different for different installations. However, it is believed that it could be the same or substantially similar for installations using the same model headbox or headboxes which have similar properties.

Comparator 40 compares the current calculated jet velocity $V_J$ which has been derived as discussed above, with a target jet velocity $V_{J(T)}$ provided from source 36. Target velocity $V_{J(T)}$ typically is set by the operator and typically is related to the velocity of wire 18. As a non-limiting example, if the wire velocity is 1600 m/min, the operator may set $V_{J(T)}$ to 1500 m/min. In general, by definition $$V_{J(T)}=V_w+\Delta V \quad (7)$$

where $V_W$ is the wire velocity; and $\Delta V$ is a positive or negative increment which the operator sets as the desired difference between the target jet velocity and the wire velocity (e.g., $\Delta V=(-100)$ in this example.

The output of comparator 40 thus depends on the difference between the current calculated jet velocity $V_J$ and the target jet velocity $V_{J(T)}$, and in this embodiment this difference signal is the control signal delivered to pump RPM control 38 in order to reduce the difference between the compared velocities. Typically, pump 22 is a positive displacement pump and the flowrate at its output tends to be close to directly proportional to the pump RPM.

The system carries out control cycles of calculating the current velocity $V_J$, comparing it with the target velocity $V_{J(T)}$ and providing a corresponding control signal to pump RPM control 38, sufficiently frequently to maintain the actual jet velocity steady and close to the target velocity. Control cycles which take place at intervals from about 1 to about 30 seconds are believed to be suitable for typical embodiments of the invention. The currently preferred frequency is once per second. Factors such as the properties of a particular installation and the preference of the operator can determine the particular cycle frequency, and could suggest even more frequent or less frequent control cycles.

Figure 4:
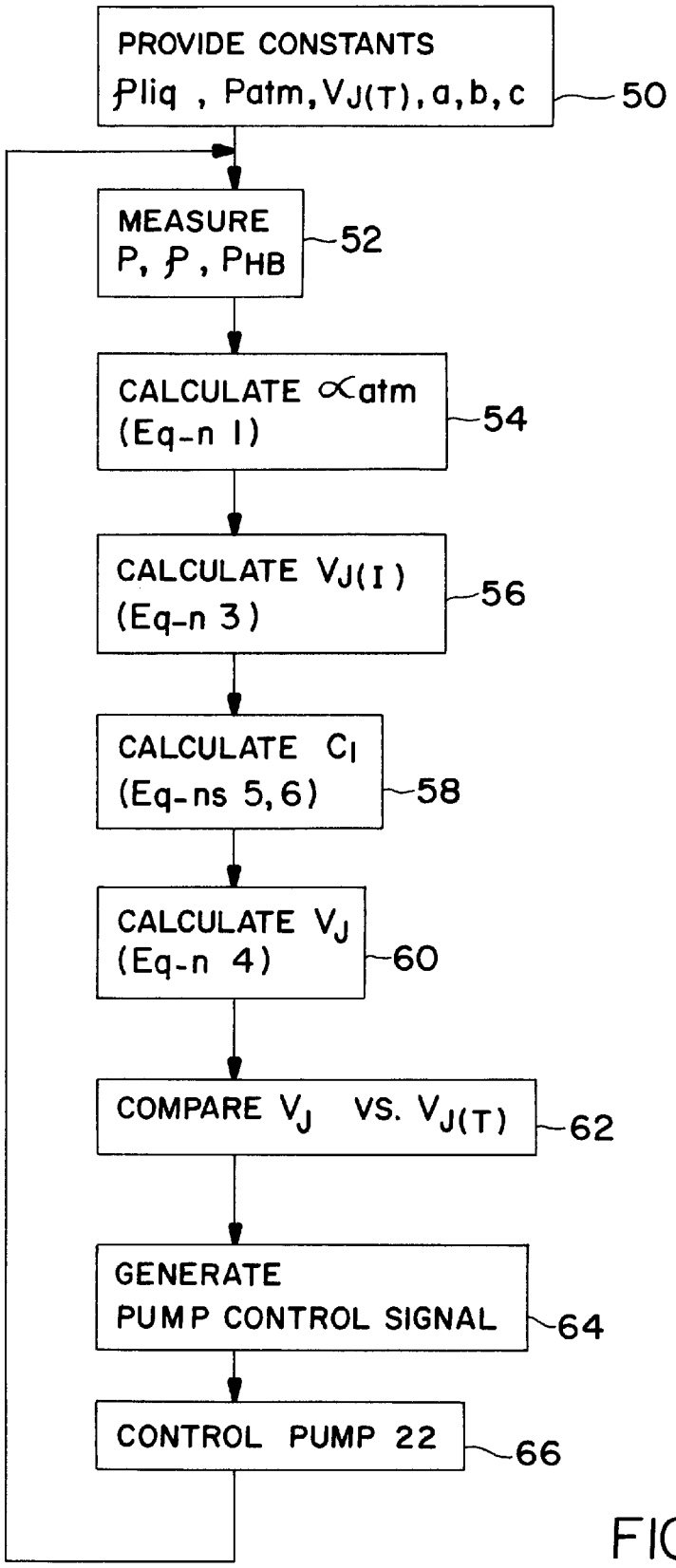
FIG. 4 is a flow chart of main steps in the process illustrated in FIG. 1.

The main steps of the invented process are illustrated in the flow chart of FIG. 4. At step 50 the system of FIG. 1 stores the indicated constants. However, as earlier noted, some of these values can be measured and supplied as variables rather than as constants. At step 52 the system measures the furnish pressure downstream from pump 22, the density of this furnish and the furnish pressure in the headbox, for example by using transmitters 26, 28 and 30. At step 54 the system calculates $\alpha_{atm}$ the current volumetric air content fraction at atmospheric pressure of the furnish downstream from pump 22, for example in accordance with equation 1 above. At step 56 the system calculates $V_{J(J)}$, the current ideal jet velocity, for example in accordance with equation 3 above. At step 58 the system calculates $C_1$, the empirical correction factor, for example in accordance with equation 6 above. At step 60 the system calculates $V_J$, the current jet velocity, for example in accordance with equation 4 above. At step 62 the system compares the calculated current jet velocity and the target jet velocity, and at step 64 generates a pump control signal based on the result of the comparison. At step 66 the control signal is applied to pump 22, to change its RPM such that the calculated jet velocity would move closer to the target jet velocity. After step 66, the process returns to step 52 to start another control cycle, and the control cycles repeat as long as control over the jet velocity is desired or until there is some reason to discontinue the process.

The process steps can be implemented in the form of the circuits illustrated in FIG. 1. However, it is preferred to carry out the calculations discussed above by means of a general purpose computer or, preferably, an industrial process control computer which usually is a part of a paper making installation, through programming such a general purpose or industrial computer to carry out the calculations discussed above and to provide a control signal which can be used as an input to pump RPM control 38 either directly or after suitable conditioning.

Figure 5:
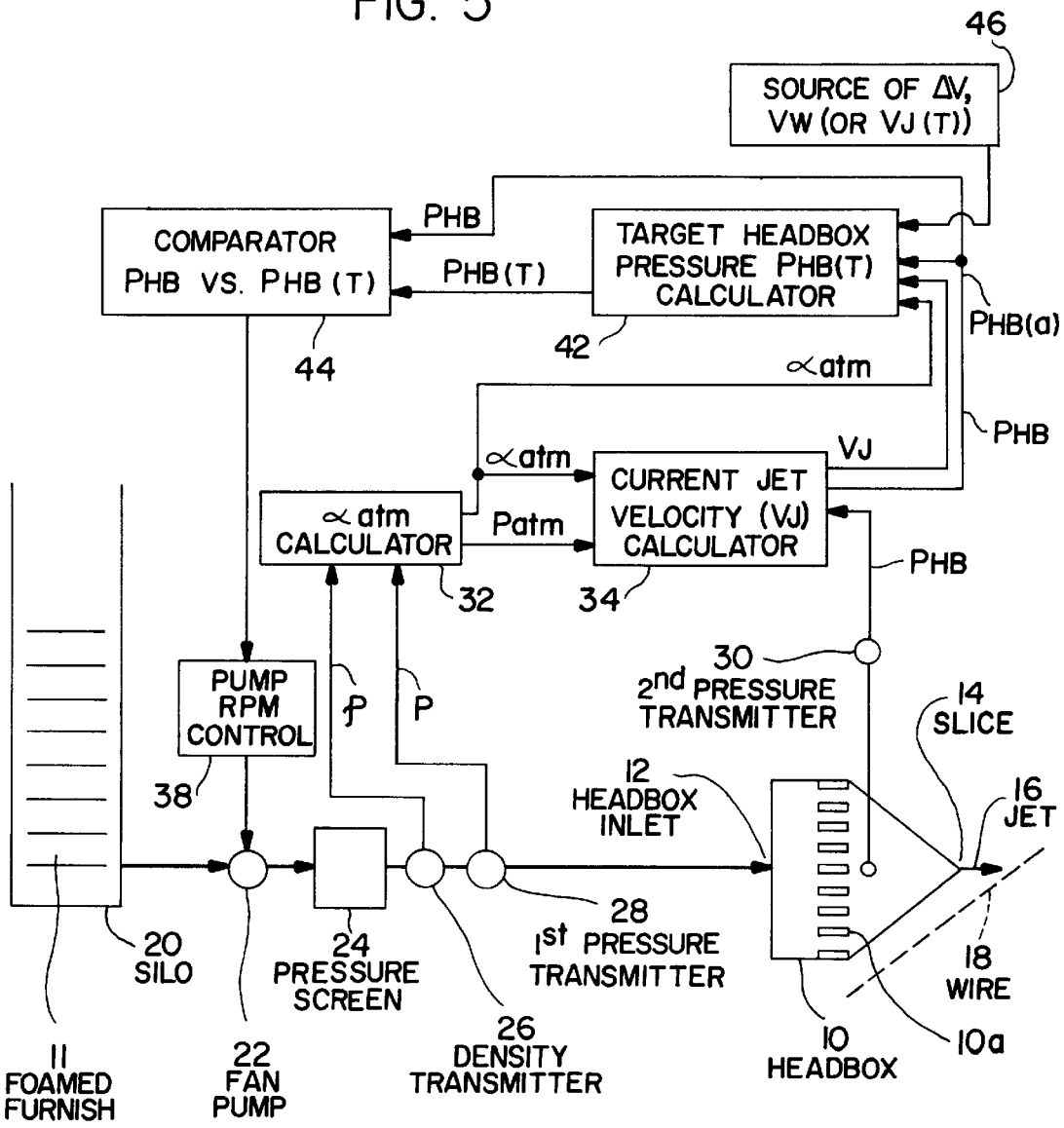
FIG. 5 a simplified schematic illustration of another exemplary embodiment of the invention controlling jet velocity on the basis of a comparison of a currently calculated target headbox pressure and a currently measured headbox pressure.

In an alternative embodiment of the invention, illustrated in FIG. 5, the process is similar in principle but derives the control signal by comparing, e.g., in a comparator 44, the actual pressure $p_{HB}$ in headbox 10, as measured by transmitter 30, with a current target pressure $p_{HB(T)}$ calculated in circuit 42 in accordance with relationships developed as a part of the invention. The target jet velocity is provided by a source 46 which, in the alternative, can provide the wire speed $V_W$ and the increment $\Delta V$. Components of FIG. 5 which serve the same function as in FIG. 1 are designated by the same reference numerals. Note that the headbox pressure measurement $p_{HB}$ in this case is supplied to both of circuits 34 and 42, and that the calculated value $\alpha_{atm}$ in this case also is supplied to both of circuits 34 and 42.

Figure 6:
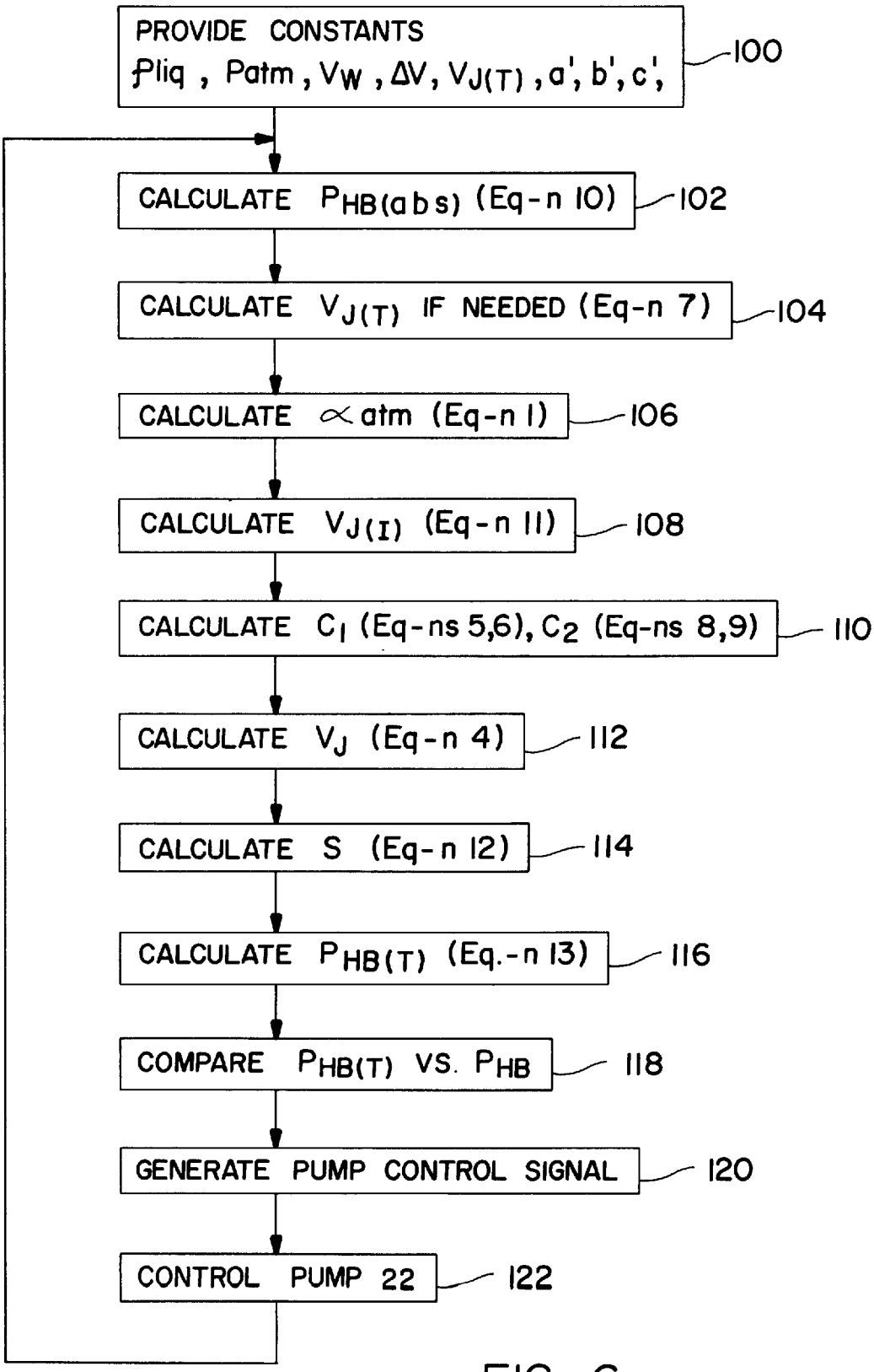
FIG. 6 is a flow chart of main steps in the alternate process illustrated in FIG. 5.

The alternate embodiment illustrated in FIG. 5 carries out a process whose main steps are illustrated in the flow chart of FIG. 6. The following notation is used in the description below of FIG. 6, where the units assumed for each variable are stated. Other units can be used if care is taken to appropriately alter the numerical constants:

$V_J$ is the calculated current calculated velocity of jet 16, e.g., in m/min;

$V_{J(T)}$ is the target velocity of jet 16, e.g., in m/min;

$\Delta V$ is an operator-specified velocity difference, defined as the difference $(V_J-V_W)$, e.g., in m/min;

$V_W$ is the velocity of the support (wire) 18, e.g., in m/min, supplied in the same manner as in FIG. 1;

$p_{HB}$ is the current pressure relative to the atmospheric pressure in headbox 10, e.g., in bar, supplied as in Fig. 1;

$p_{HB(abs)}$ is the current absolute pressure in headbox 10, e.g., in bar, derived in circuit 42 as the sum $(p_{HB}+p_{atm})$;

$p_{HB(T)}$ is the target pressure in headbox 10, e.g., in bar, derived in circuit 42;

$p_{atm}$ is the atmospheric pressure, e.g., in bar (e.g., 1.01325 bar), supplied as in FIG. 1;

ρliqis the density of the liquid phase of furnish 11, e.g., in $kg/m^3$ (e.g., approx. 1000 $kg/m^3$ when the liquid phase is water), supplied as in FIG. 1;

$V_{J(I)}$ is the current calculated ideal velocity of furnish jet 16, e.g., in m/min ($V_J=C_1V_{J(I)}$), calculated as in FIG. 1;

g is acceleration due to gravity, e.g., in $m/sec^2$;

$\Delta h$ is the elevation difference, e.g., in meters, between pressure transmitter 30 and jet 16 (>0 when jet 16 is at a lower elevation than pressure transmitter 30);

$\alpha_{atm}$ is the volumetric air fraction of the furnish at atmospheric pressure (i.e., if the air content of furnish 11 at atmospheric pressure is 62% by volume, $\alpha_{atm}$ is 0.62), calculated as in FIG. 1;

$C_1$ is a first empirically derived correction factor, derived as in FIG. 1, e.g., for a particular experimental installation of the assignee is, as in equation (6) above, $C_1=1.000+0.000246(V_{J(I)}-1510)$;

$C_2$ is a second empirically derived correction factor, derived in a manner similar to that for $C_1$, e.g., the general expression used in the curve-fitting process is $$C_2=a'+b'(V_{J(T)}-c') \tag{8}$$

and, for the assignee's particular experimental installation $$C_2=1.000+0.0001887(V_{J(T)}-1510); \tag{9}$$

S is the slope of the $V_J^2$ vs. $p_{HB}$ curve (i.e., $(dV_J^2)/dp_{HB}$), derived in circuit 42 as a numerical approximation of the indicated derivative, e.g., in $(m^2/min^2)$/bar.

Referring to FIG. 6:

At step 100 the system provides the indicated constants. Note that either the target jet velocity can be stored as a constant or there can be stored the constants $\Delta V$ and $V_W$.

At step 102, calculator 34 calculates $$p_{HB(abs)}=p_{HB}+p_{atm} \tag{10}$$

where, $p_{atm}$ can be 1.01325 bar.

Unless the target jet velocity has already been provided at step 100, at step 104 source 46 calculates the target jet velocity in accordance with expression (7) above, i.e., $V_{J(T)}=V_W+\Delta V$, where $\Delta V$ is provided to step 100 by the operator and $V_W$ is either specified by the operator or is measured by a suitable transducer and supplied to step 100.

At step 106 calculator 32 calculates αatm, e.g., in accordance with expression 1 as in FIG. 1.

At step 108, calculator 34 calculates the current ideal jet velocity $V_{J(I)}$, e.g., in accordance with $$V_{J(I)}^2=7200\{(10^5p_{HB})/\rho liq+g\Delta h+[(10^5\alpha_{atm}p_{atm})/\rho_{liq}(1-\alpha_{atm})][\ln(p_{HB(abs)}/p_{atm})\} \tag{11}$$

using in this step the current value of $\alpha_{atm}$ calculated in step 106. Note that equation 11 is a special case of equation 3, in that additional numerical factors are included (7200, $10^5$) for use with units of m/min for $V_{J(I)}$; bar for $p_{HB}$, $p_{atm}$ and $p_{HB(abs)}$; and $kg/m^3$ for $\rho_{liq}$.

At step 110 calculator 42 calculates the correction factor $C_1$, e.g. in accordance with expression (6) above as in FIG. 1, i.e., in accordance with $C_1=1.000+0.000246(V_{J(I)}-1510)$, and calculates the second correction factor $C_2$ in accordance with expression (9) above.

At step 112, calculator 42 calculates the current jet velocity $V_J$, e.g., in accordance with expression (4) above.

At step 114, calculator 42 calculates the slope S in accordance with $$S=[7.2(10)^8C_2^2/\rho liq]\{1+[\alpha_{atm}p_{atm}]/[(1-\alpha_{atm})p_{HB(abs)}]\} \tag{12}$$

At step 116 calculator 42 calculates the current target (setpoint) pressure $p_{HB(T)}$ in headbox 10 in accordance with $$p_{HB(T)}=p_{HB}+(V_{J(T)}^2-V_J^2)/S \tag{13}$$

At step 118, comparator 44 compares the current calculated target pressure $p_{HB(T)}$ with the measured headbox pressure $p_{HB}$.

At step 120, comparator 44 generates a pump control signal as a function of the comparison at step 118.

At step 122, control 38 controls pump 22 to bring the calculated target pressure closer to the measured pressure in the headbox, thereby bringing the calculated jet velocity closer to the target velocity.

After step 122, the process returns to step 102 to start another control cycle, and the control cycles repeat as long as control over the jet velocity is desired or until there is some reason to discontinue the process. The cycles repeat at a suitable frequency, e.g., repeat after an interval in the range of about 1–30 seconds, preferably once per second.

The FIG. 6 process steps can be implemented in the form of the circuits illustrated in FIG. 5. However, as in the case of FIG. 1, it is preferred to carry out the calculations discussed above by means of a general purpose computer or, preferably, an industrial process control computer which usually is a part of a paper making installation, through programming such a general purpose or industrial computer to carry out the calculations discussed above and to provide a control signal which can be used as an. input to pump RPM control 38 either directly or after suitable conditioning.

Each of the processes illustrated in FIGS. 4 and 6 is a preferred embodiment of the invention. Both have been implemented on experimental basis, and both are believed to provide unexpectedly superior results as compared with the known prior art. Of course, many variations of the particular examples discussed above are possible in accordance within the principles of the invention, the scope of which is defined by the appended claims.

The following components are believed to be suitable for the exemplary embodiments discussed above:

10 Headbox: Beloit Low convergence Concept III Stratified Headbox;

18 Wire: Appleton Wire—84M;

20 Silo: Vented fiberglass tank; 4 ft. diameter×10 ft. high (active foam depth about 6 ft.);

22 Fan Pump: Dresser External Screw—Twin Screw Positive Displacement Pump (NJHP);

24 Pressure Screen: Black-Clawson P24;

26 Density Transmitter: Kay-Ray Model No. 3680AAE200C2, calibrated 0 to 1.0 SGU;

28 First Pressure Transmitter: PMC Model No. PT-EL, calibrated 0–100 PSIG;

30 Second Pressure Transmitter: Rosemount Model No. 3051CG4A22AlAB4, calibrated 0–60 PSIG;

32 Calculator: Microprocessor-based distributed process control system Measurex Model 2002ET programmed to carry out the processes discussed above;

34 Same as 32;

36 Same as 32;

38 Same as 32, but adds A-C Variable Speed Drive, Reliance 250HP;

40 Same as 32.

It is noted that the parameter $\alpha_{atm}$ derived in each process cycle by calculator 32 can be used in another control loop, where a comparator (not shown) compares the current value of $\alpha_{atm}$ with a target value which can be stored as an operator-selected constant, and in response produces a control signal to control the feeding of surfactant to the furnish delivered to pump 22 to move the calculated value of $\alpha_{atm}$ closer to the target value.

The invention is sufficiently broad to be implemented in ways which are different from the examples set forth above but still are within the scope of the invention defined by the appended claims.

I claim:

1. A method of controlling the velocity of a jet of foamed furnish leaving a pressurized headbox of a paper or a tissue making machine comprising the steps of:

operating a pump to provide flow of foamed furnish;

measuring the density of the flow of foamed furnish and the pressure of said flow of foamed furnish before and in the headbox;

using said measurements to estimate an atmospheric pressure air content $\alpha_{atm}$ of the foamed furnish in accordance with $$\rho=\rho_{liq}\{](1-\alpha_{atm})P_{abs}]/[(1-\alpha_{atm})\ P_{abs}+\alpha_{atm}P_{atm}]\}$$

where ρ is the density of the furnish, $\rho_{liq}$ is the density of the liquid phase, $p_{abs}$ is the absolute pressure of the furnish downstream, $\alpha_{atm}$ is the current volumetric air content fraction at atmospheric pressure, and $P_{atm}$ is the absolute atmospheric pressure;

delivering said flow of foamed furnish to a pressurized headbox having a slice emitting a jet of said foamed furnish and measuring the pressure of the foamed furnish in the headbox and thereafter calculating an ideal jet velocity in accordance with $$(V_{J(I)})^2=2\{(P_{HB(abs)}-P_{atm})/\rho liq+g\Delta h+[(\alpha_{atm}P_{atm})/\rho_{liq}(1-\alpha_{atm})][\ln(P_{HB(abs)}/P_{atm})]\}$$

where $V_{J(I)}$ is the current ideal jet velocity, $P_{HB(abs)}$ is the absolute pressure in the headbox, $P_{atm}$ is the absolute atmospheric pressure, g is the acceleration due to gravity, Δh is an elevation difference, and $\alpha_{atm}$ is the current volumetric air content fraction at atmospheric pressure;

estimating the current actual velocity of said jet of foamed furnish using the estimated atmospheric pressure air content and the measured pressure in the headbox in accordance with $V_J=C_1V_{J(I)}$, where $C_1$ is a correction factor equal to a+b $(V_{J(I)}-c)$ where a, b, and c are predetermined coefficients; and comparing the estimated current velocity of said jet of foamed furnish with a target velocity and controlling said pump to move the estimated and target velocities closer to each other.

2. A method of controlling a jet of foamed furnish leaving a pressurized headbox of a paper or a tissue making machine comprising the steps of:

feeding foamed furnish to a pressurized headbox to form a jet of said furnish;

measuring the density and pressure of the foamed furnish before and in the headbox;

providing a target velocity of the jet;

estimating a current target pressure of the foamed furnish in the headbox using said measurements of density and pressure in accordance with $$P_{HB(T)}=P_{HB}+(V_{J(T)}^2-V_J^2)/S,$$

where $P_{HB(T)}$ is the target pressure in the headbox, $P_{HB}$ is the current pressure relative to the atmospheric pressure in the headbox, $V_{J(T)}$ is the target velocity of the jet, $V_J$ is the current calculated velocity of the jet, and S is the slope of the $V_J^2$ vs. $P_{HB}$ curve;

Wherein $V_J$ is calculated in accordance with $$V_J = C_1 V_{J(I)},$$

where

C1 is a correction factor equal to a+b ($V_{J(I)}$−c) where a, b, and c are predetermined coefficients and $V_{J(I)}$ is derived in accordance with $$V_{J(I)}^2 = 7200\{(10^5 P_{HB})/\rho liq + g\Delta h + [(10^5 \alpha_{atm} P_{atm})/\rho_{liq}(1-\alpha_{atm})][\ln(P_{HB(abs)}/P_{atm})]\}$$

where $P_{HB}$ is the current pressure relative to the atmospheric pressure in the headbox, ρliq is the density of the liquid phase, Δh is an elevation difference, $\alpha_{atm}$ is the current volumetric air content fraction at atmospheric pressure, $P_{atm}$ is the absolute atmospheric pressure, $P_{HB(abs)}$ is the absolute pressure in the headbox, $$S = [7.2(10)^8 C_2^2/\rho_{liq}]\{1+[\alpha_{atm} P_{atm}]/[(1-\alpha_{atm})P_{HB(abs)}]\}$$

and $C_2$ is an empirically derived correction factor; and comparing the measurement of pressure in the headbox with the current target pressure in the headbox to derive a control signal; and utilizing the control signal to control the feeding step to move the pressure in the headbox and the current target pressure in the headbox closer to each other.

* * * * *

UNITED STATES PATENT AND TRADEMARK OFFICE

CERTIFICATE OF CORRECTION

PATENT NO. : 6,355,142 B1
DATED : March 12, 2002
INVENTOR(S) : Frederick W. Ahrens It is certified that error appears in the above-identified patent and that said Letters Patent is hereby corrected as shown below:

Title page,
Item [73], should read:
-- [73] Assignee: Fort James Corporation,
Deerfield, IL --

Signed and Sealed this

Sixth Day of April, 2004

JON W. DUDAS
*Acting Director of the United States Patent and Trademark Office*